United States Patent [19]

Ladner

[11] Patent Number: 4,583,745

[45] Date of Patent: Apr. 22, 1986

[54] DART FLIGHT

[76] Inventor: Emory G. Ladner, 15 Woodward Ave., Quincy, Mass. 02169

[21] Appl. No.: 723,134

[22] Filed: Apr. 15, 1985

[51] Int. Cl.[4] ..... A63B 65/02

[52] U.S. Cl. ..... 273/423

[58] Field of Search ..... 273/423, 420, 416

[56] References Cited

U.S. PATENT DOCUMENTS

| | | | |
|---|---|---|---|
| 4,114,883 | 9/1978 | Fuscone | 273/106.5 |
| 4,114,884 | 9/1978 | Tunnicliffe | 273/106.5 |

FOREIGN PATENT DOCUMENTS

| | | | |
|---|---|---|---|
| 519920 | 4/1940 | United Kingdom | 273/423 |
| 750897 | 6/1956 | United Kingdom | 273/423 |
| 779616 | 7/1957 | United Kingdom | 273/423 |
| 1313013 | 4/1973 | United Kingdom | 273/423 |
| 1488373 | 10/1977 | United Kingdom | 273/420 |
| 1527952 | 10/1978 | United Kingdom | 273/423 |

*Primary Examiner*—Paul E. Shapiro

*Attorney, Agent, or Firm*—Francis J. Caufield

[57] ABSTRACT

A dart flight that is fabricated either of a single integral piece of thin, flexible plastic or of two separate pieces. The flight can be attached to the end of a dart shaft in a conventional manner to protect it from subsequently thrown darts and, more importantly, to shroud the shaft end with a gradually tapering smooth surface which deflects subsequently thrown darts from the end of the shaft with minimum deviation from their original course so that valuable points are not lost during competition.

7 Claims, 9 Drawing Figures

DART FLIGHT

BACKGROUND OF THE INVENTION

This invention in general relates to the game of darts and, in particular, to the structure of a dart flight which attaches to the end of a shaft in a conventional way to improve scoring and protect the shaft from subsequently thrown darts.

Dart flights are well-known having beginnings as feathery attachments to one end of a wooden shaft in which the point was centered at the other end, a structure not uncommon even today, although now more likely found duplicated of injection molded plastic to which the steel point is attached.

The more contemporary dart design, however, is a more precise instrument generally comprised of a more or less precision turned central barrel having the point centered in one end and a steel and plastic or plastic slotted shaft centered in the opposite, or trailing, end. To the trailing end attaches a thin, flight, usually of four wings, which is used to aid balance and enhance stability throughout flight to the board. The flight, sometimes of plastic, releasably attaches to the end of the trailing shaft by way of slots, cruciform in section, which are provided for this purpose.

However, most of the known arrangements along these general lines have the disadvantage that they leave the end of the trailing shaft exposed, particularly the prongs, such that subsequently thrown darts can inflict serious damage to the previously thrown dart stuck in the board to be deflected off course so much that scoring is seriously affected, or in the worst case can dislodge darts already in the board while not entering themselves.

Those in the art have recognized this problem and have proposed a solution in the form of a metal cap which inserts in a cutout portion from the central spine of a flight and fits over the trailing shaft end to protect it and deflect subsequently thrown darts, as shown for example in U.S. Pat. No. 4,114,884 issued to Leonard Alfred Tunnicliffe on Sept. 19, 1978.

In spite of the advances made in this field, there is still a need for improved dart structures and, specifically, dart flight design. Of course, material cost and ease of fabrication of dart flights is always a consideration.

Consequently, it is a primary object of the present invention to provide the art with an inexpensive, easily manufactured dart flight which will improve scoring performance and protect dart shafts from injury from subsequently thrown darts.

Other objects of the invention will, in part, be obvious and will, in part, appear in the detailed description that is to follow.

SUMMARY OF THE INVENTION

This invention in general relates to the game of darts and in particular to the structure of a dart flight which attaches to the end of a dart shaft to improve scoring possibilities and shroud the shaft end to protect it from damage from subsequently thrown darts.

The dart flight is primarily useful with a dart having a shaft of the type having a distal end adapted to releasably receive flights of the general type of the invention. The flight itself comprises a spine section that is adapted to attach to the shaft distal end and a wing section having a plurality of wings extending outwardly from the spine section and adapted to fit over the distal shaft end to protect it from subsequently thrown darts by presenting to the point of a subsequently thrown dart a smooth, gradually tapered surface effective to act as a guide for directing a dart point contacting it such that the later thrown dart passes by a dart already in the board with minimum deviation from its original course.

In the preferred embodiment, the spine and the wing section are separate pieces fabricated of thin, plastic sheet material such as mylar. These two pieces are preferably cut out of the sheet material as developed parts which are afterwards folded into their final form and attached to one another with a releasable adhesive. In fitting together, surfaces between adjacent wing sections and portions of the spine define pockets which perform the shrouding and deflecting functions.

DESCRIPTION OF THE DRAWINGS

The invention itself is set forth with particularity in the appended claims. However, to understand its structure and function, along with other advantages thereof, reference may be had to the description which follows when read in connection with the drawings wherein like numbers have been used in the various figures, and wherein:

DETAILED DESCRIPTION

This invention is a dart flight which can be fabricated easily and economically and which attaches to the end of a dart shaft to improve scoring and protect the end of the shaft from damage from subsequently thrown darts.

Figure 1:
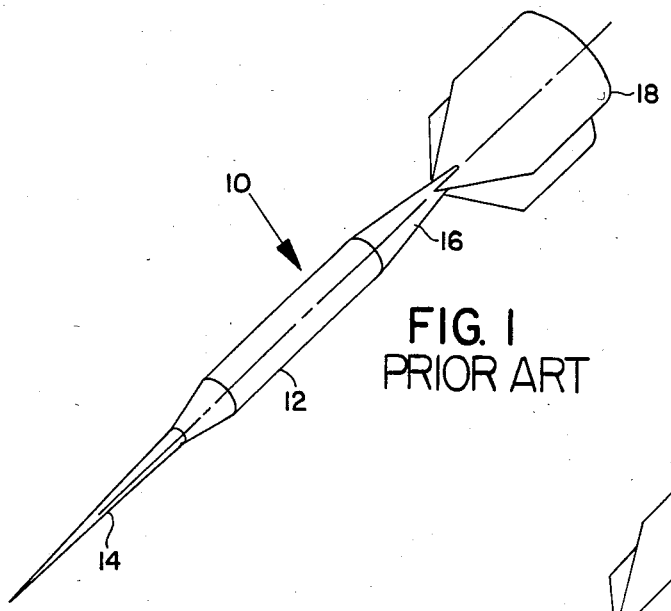
FIG. 1 PRIOR ART
FIG. 1 is a diagrammatic perspective view of a well-known dart included to illustrate the state of the art of dart flights.
Figure 2:
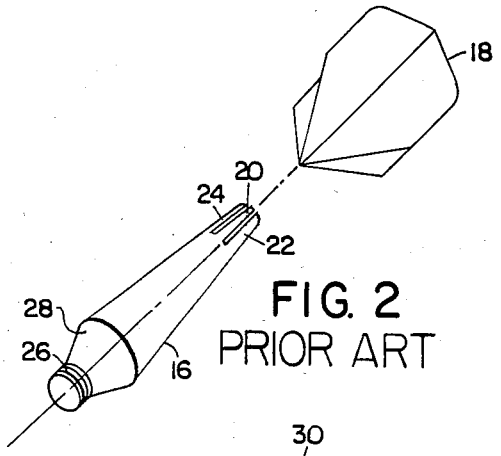
FIG. 2 PRIOR ART
FIG. 2 is an exploded diagrammatic perspective view of the trailing shaft and the flight of the dart of FIG. 1 with the trailing shaft enlarged relative to the flight.

To best understand the structure and advantages of the present dart flight, it will be useful to be familiar with conventional dart construction such as that shown in FIGS. 1 and 2 where a dart of well-known structure is designated generally a 10. The dart 10 comprises a central barrel 12 with a point 14 attached to its forward end, and also includes at its other end a rearwardly extending shaft 16. The shaft 16 attaches to the rear end of the barrel 12 via a screw 26 on the end of a conical taper 28 which fits into a complimentary configured recess provided, but not shown, in the barrel rear end.

A well-known dart flight 18 is part of the dart 10 and comprises four wings extending outwardly at right angles from a spine so that its cross section is cruciform in shape. Flight 18 attaches to the end of the shaft 16 by being inserted into two slots at right angles to one another in the distal end of the shaft 16 and formed between four prongs, only three of which show in FIG. 2 at 20, 22, and 24.

This construction leaves the prongs, 20–24, exposed and vulnerable to the possibility of being stabbed by subsequently thrown darts, thereby being subject to damage requiring replacement of the shaft or, perhaps worse, causing a subsequently thrown dart to be deviated from its intended target in the board thereby causing a reduction in score or no addition to score because the deviated dart never enters the board. The former represents an economic loss which, however small in material costs, can become substantial in high stakes competitive play. Player concentration and timing can also be influenced by such collisions thereby jeopardizing his chances of winning the game.

Figure 3:
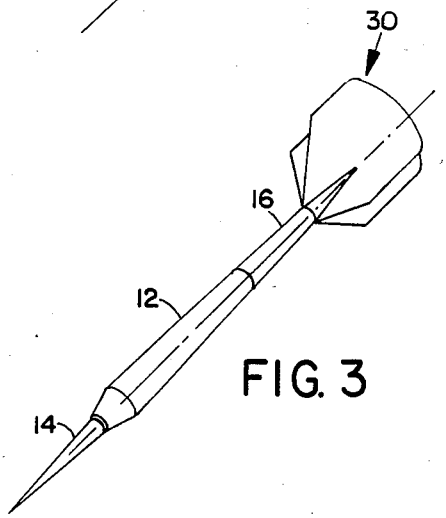
FIG. 3 is a diagrammatic perspective view of a dart to which the inventive flight is attached.

The present inventive dart flight, illustrated at 30 in FIGS. 3 and 4, removes almost all risk of breaking shafts during competition by protecting the shaft with a shroud which guides the point of a subsequently thrown dart over and by the prongs of a dart already in the board. How the flight 30 achieves this will best be understood by now referring to FIGS. 3 through 7 where it can be seen that the flight 30, the preferred embodiment of the invention, comprises two major parts, a spine section 32 and a wing section 34 both of which are fabricated of a thin sheet of plastic material such as polyester film as that, for example, manufactured by E. I. Dupont de Nemours and Co. under its registered trademark Mylar mylar or other suitable substitute.

Figure 5:
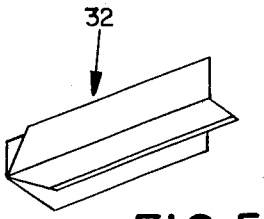
FIG. 5 is an enlarged diagrammatic perspective view of the spine section of the inventive flight.
Figure 6:
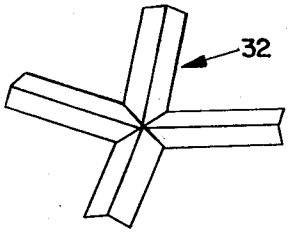
FIG. 6 is a diagrammatic perspective view of the spine section of FIG. 5 shown in unfolded fashion.
Figure 9:
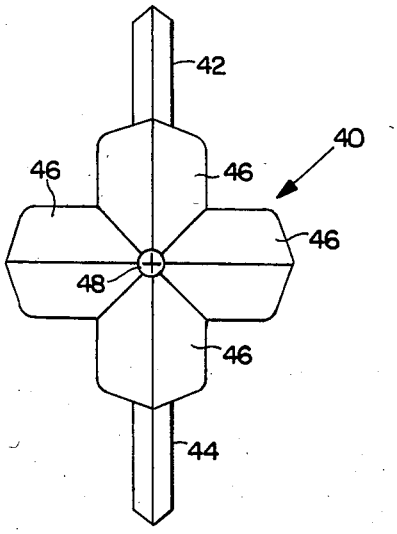
FIG. 9 is a diagrammatic plan view of a developed one-piece alternate version of the invention.

The spine section 32 is a developed piece as best shown in FIG. 6 and, when folded, is as shown in FIG. 5 where it is seen to be cruciform in cross section so that it can fit into the end of a conventional dart shaft such as that shown previously at 16. The forward end of the spine section 32 is tapered at angles which follow those of the forward end of the wing section 34 to paralleling them as shown best in phantom in FIG. 4.

Wing section 34 is also developed, that is, is a three-dimensional surface superimposed on a two-dimensional surface without stretching. Like the spine section 32, the wing section 34 is foldable to its shape shown also in FIG. 4.

Wing section 34, however, is made of a material whose thickness is preferably less than that of the spine section 32 so that the spine section 32 is stiffer and therefore more robust for attachment and stability purposes.

Figure 8:
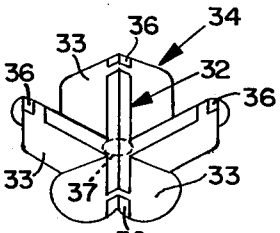
FIG. 8 is a diagrammatic perspective view showing the wing section of the invention unfolded with the spine section overlying part of the wing section and the tape shown in FIG. 7.
Figure 7:
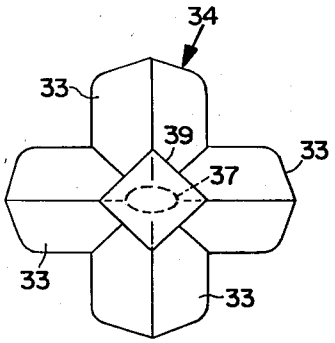
FIG. 7 is a diagrammatic perspective view showing the wing section of the invention unfolded with a piece of tape attached.

Wing section 34 and spine section 32 attach to one another in the manner shown in FIGS. 7 and 8 by means of a releasable adhesive and tape. As seen in FIG. 7, the wing section 34 is provided with a central hole 37, noncircular in shape, over which is placed a piece of tape 39. After putting the tape 39 in place, a resealable adhesive is placed over the remaining inside surface of the wing section 34 taking care not to get any of the adhesive under the tape 39. Afterwards, the tape 39 is removed and the spine section 32 laid in as shown in FIG. 8. Thus, the tape 39 masks a central rectangular inside area of the wing section 34 that is coextensive with the area of the tape 39 and thus is uncoated with any resealable adhesive. This is important for reasons which will follow.

As seen in FIG. 8, the forward end of the spine section 32 extends through a hole 37. In addition, small pieces of double-backed tape, shown typically at 36, or other suitable adhesive, are placed near the center of the trailing edges of the wings 33 to further aid in keeping the wings 33 in their proper configuration when folded.

Figure 4:
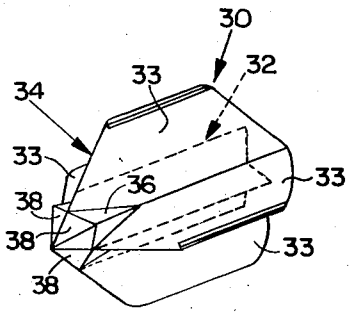
FIG. 4 is a diagrammatic perspective view of the inventive flight with parts shown partially in phantom.

Now with this structure, as best shown folded in FIG. 4, the flight 30 is attached to the shaft 16 by first pushing the forward end of the spine section 32 into the crossed slots provided in the shaft 16 to receive the spine section 32. Because the wing section 34 has a forward facing whole 37, is flexible, and has an area which has no adhesive, it easily spreads away from the spine section 32 under the influence of the camming action provided by the prongs (20–24) to form pockts 38 (Only 3 shown in FIG. 4) between adjacent wings and portions of the spine section outwardly facing surfaces.

These pockets, 38, shroud the prongs (20–24) to protect them against damage from subsequently thrown darts and provide a smooth, gradually tapered surface effective to gently guide the points of follow-on darts so that they are deviated from their original course by minimum distances thereby improving scoring possibilities. Alternatively, the pocket 38 can be formed by proper folding of the flight before attachment to the shaft 16.

In addition to the foregoing advantages for this structure, it should be recognized that the use of resealable adhesive for assembly purposes allows the flight to be used with a variety of dart shafts of different geometry and slot depth.

FIG. 8 shows an alternate embodiment of the invention. A one-piece version is illustrated there as a developed section designated generally at 40. Section 40 includes wing sections, typically at 46, a central hole 48, and spine sections, 42 and 44, which oppose each other from two of the wing sections, 46. Flight 40 folds as above to final configuration and is also made of a suitable plastic sheet material.

Both flights 30 and 40 may be stamped from suitable dies either as developed sections as shown or can be partially folded and then die cut.

It will be appreciated by those skilled in the art that other changes may be made to the invention without departing from the scope of its teachings. Therefore, all that is disclosed in the foregoing description or shown in the drawings is to be considered as illustrative and not in a limiting sense.

What is claimed is:

1. A dart flight for use with a dart having a shaft of the type having a distal end adapted to releasably receive a flight, said flight comprising a spine section adapted to attach to the distal end of the dart shaft and a wing section having a plurality of wings extending outwardly from said spine section and including surfaces between adjacent wings thereof and said spine section for providing pockets therebetween adapted to fit over the distal end of the shaft to protect it from subsequently thrown darts by presenting to the point of subsequently thrown darts a smooth gradually tapered surface which shrouds the shaft distal end and is effective to deflect darts contacting it with a minimum deviation from their original course.

2. The dart flight of claim 1 wherein said spine section and said wing section are integrally formed of a thin, plastic sheet material.

3. The dart flight of claim 1 wherein said spine section and said wing section both are separate pieces fabricated of thin, plastic sheet material.

4. The dart flight of claim 3 wherein said spine section and said wing section are fabricated of different materials of different thickness so that said spine section is stiffer than said wing section.

5. The dart flight of claim 2 wherein said spine section and said wing section both are initially formed as developments and are afterwards folded into their final respective form.

6. The dart flight of claim 5 wherein said spine section and said wing section are assembled together into said flight with a resealable adhesive.

7. A dart flight for use with a dart of the type having a shaft with a distal end having at least two rearwardly extending prongs which between them form a slot for releasably receiving a flight, said dart flight comprising a spine section having a portion defining a forward end thereof shaped to slidably fit into said slot formed between said prongs for attaching said dart flight to said shaft and a wing section having a plurality of wings extending outwardly from said spine section and including surfaces between adjacent wings thereof and said spine section for providing pockets therebetween for fitting over said prongs of said shaft to protect them form subsequently thrown darts by presenting to their points a smooth, gradually tapered surface which shrouds said prongs of said shaft distal end and is effective to deflect darts contacting it with a minimum deviation from their original course.

* * * * *